US011077584B2

(12) United States Patent
Brooks

(10) Patent No.: US 11,077,584 B2
(45) Date of Patent: Aug. 3, 2021

(54) CONCRETE PICKET FENCE REPLACEMENT

(71) Applicant: Ray Brooks, Fort Worth, TX (US)

(72) Inventor: Ray Brooks, Fort Worth, TX (US)

( * ) Notice: Subject to any disclaimer, the term of this patent is extended or adjusted under 35 U.S.C. 154(b) by 268 days.

(21) Appl. No.: 16/506,428

(22) Filed: Jul. 9, 2019

(65) Prior Publication Data

US 2021/0008760 A1 Jan. 14, 2021

(51) Int. Cl.
*B28B 19/00* (2006.01)
*E04H 17/06* (2006.01)
*E04H 17/14* (2006.01)

(52) U.S. Cl.
CPC ..... *B28B 19/0092* (2013.01); *E04H 17/06* (2013.01); *E04H 17/1426* (2013.01)

(58) Field of Classification Search
None
See application file for complete search history.

(56) References Cited

U.S. PATENT DOCUMENTS 3,475,017 A * 10/1969 Knorr ..... E04G 13/025 269/124
7,794,825 B2 * 9/2010 Kudrick ..... B28B 7/346 428/292.1
9,574,370 B2 * 2/2017 Presti ..... E04H 17/1439
2017/0272028 A1 * 9/2017 Reinert ..... E02D 5/54
2019/0292809 A1 * 9/2019 Nelson ..... E04H 17/168
2019/0330878 A1 * 10/2019 Presti ..... E04H 17/143
2020/0263370 A1 * 8/2020 Tryon ..... G10K 11/16
2021/0123241 A1 * 4/2021 Meyer ..... E04F 11/1851

FOREIGN PATENT DOCUMENTS

DE 29719057 * 12/1997
JP 06229058 A * 8/1994

* cited by examiner

*Primary Examiner* — Jonathan P Masinick

(57) ABSTRACT

Concrete Picket Fence Replacement is an innovative upgrade to designer and durable fencing, comprising the strength of concrete, steel, and stone to create a series of interlocking panels, capable of resisting the destructive forces of wind, water, fire, and deterioration from insects and animals. In preferred embodiments, a strong matrix of Concrete Picket Fence boards are adhered vertically along a horizontal metal pipe by welding metal points of contact, creating a solid fence panel anchored to the ground by metal fence posts secured by concrete. To date, concrete and steel have not been combined in such fashion. The return will be a conservation of trees and lower costs due to loss, theft, and replacement cost.

1 Claim, 5 Drawing Sheets

CONCRETE PICKET FENCE REPLACEMENT

CROSS REFERENCE TO RELATED APPLICATIONS

This application claims priority to and the benefit of the filing date of U.S. Provisional Application No. 62/763,509, filed on Jul. 9, 2018, entitled "CONCRETE PICKET FENCE REPLACEMENT", which is hereby incorporated by reference in its entirety.

BACKGROUND OF THE INVENTION

In the past century, wood, concrete, and steel have been used to construct barriers to protect against intrusion, theft, or simply to mark property lines between neighbors. Protecting cattle from roaming or being poached is a main concern in the agricultural industry that requires continuous maintenance of fencing for ranchers. Homeowners also desire adequate fencing to protect and beautify their home, but replacement costs can be a dampener on the budget. Now, there is a need for fencing made from a stronger material that protects the home without compromising the appearance.

BRIEF SUMMARY OF THE INVENTION

Concrete Picket Fence Replacement is the solution to rising replacement and maintenance costs associated with deterioration of fences. Wood is a corruptible material that has long been known to grow old and brittle, susceptible to such threats as wind, water, fire, and destruction from abuse or excessive use.

Concrete Picket Fence Replacement is a more durable structure constructed in the likeness of wooden panels, consisting of concrete, metal, and rock. Because the concrete panels are bonded using welds instead of nails, they are stronger and provide more security than wooden fence panels, which are easily separated or broken due to the bonds applied during installation.

The special cast construction of the Concrete Picket Fence Replacement allows for the formation of many different panels of sizes 2 ft. to 8 ft. in height with many options in appearance like the traditional picket style, round or square top, with horizontal or vertical panels. These are just a few designs in the construction of the panels and other shapes and sizes can be created depending on the precast mold used.

DESCRIPTION OF VIEWS AND DRAWINGS

For this model we use a standard frame mold with dimensions 2"×3"×6', and is constant throughout the illustration. We also made and used pre-cut expanded metal skeletons 2 welded in 4" increments along the length of the frame 1. We use a standard 3000 psi mix 3 for the interior of the form. One finished solid frame 6A is the view of the completed Concrete Picket Fence Replacement with only a skeleton and frame, before it is filled with concrete to create a full product 7. Some embodiments of the present invention are illustrated as an example and are not limited by the figures of the accompanying drawings, in which like references may indicate similar elements and in which:

DETAILED DESCRIPTION OF THE INVENTION

The terminology used herein is for the purpose of describing some particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence of addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and subsequent claims should be read with the understanding that such combinations are entirely within the scope of the invention and the claims.

Concrete picket fence replacement panels, boards, frames, and methods for combining metal and concrete to form solid finished frames in an interlocking series are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures of description below.

Figure 1:
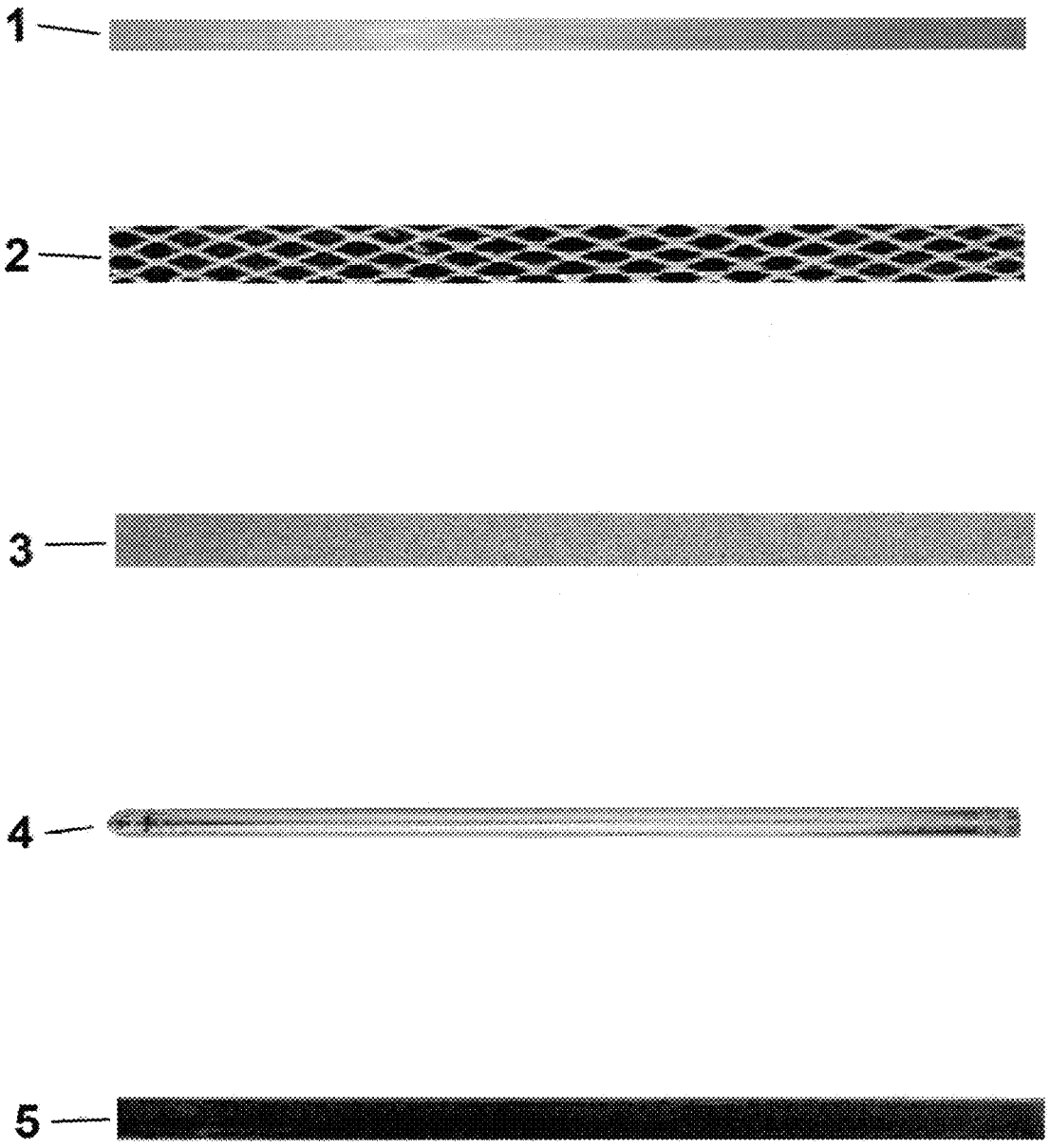
FIG. 1 depicts an exploded perspective view of one example of a concrete picket fence replacement in construction phase according to various embodiments of the present invention.

The present invention will now be described by referencing the appended figures representing preferred embodiments. FIG. 1 depicts an exploded perspective view of one example of a concrete picket fence replacement in construction phase according to various embodiments of the present invention. In preferred embodiments, each of the panels are comprised of a solid, one inch wide 1/16" metal plate 1 and are used to secure the panel and create a solid frame. Metal plates may be of various thicknesses according to specification of the intended fence design and intended to be a limitation on the present invention as described herein. This metal frame can be one solid frame cast from a mold, cut from a sheet, or adjoined with welded secure bonds.

A precast piece of flat expanded metal 2 may be welded to the inside of the metal plate 1 creating one solid frame. The dimensions and composition of the metal 2 used can vary depending on the specification and are not intended to be a limitation on the present embodiment described herein. The solid frame described above may then be filled flush with the hardened concrete mix 3 and a metal trowel is shaved along the front face to remove excess concrete. The concrete picket fence replacement form is then dried overnight and cured with a hardening agent to add increased strength. The add mixture can vary depending on requirements for various environments, climates, exposures, and uses and is not intended to be a limitation on the preferred embodiment described herein.

Several pieces of 3" metal pipe 4 may be affixed and secured vertically in the ground in sections of every three feet, by using concrete with at least three feet of the metal pipe 4 below the surface. Sections of 2"×2" metal tube 5 may then be welded horizontally across the metal pipe 4 and act as stable back posts for the finished frame 6. In some embodiments, the metal tube 5 may be of various sizes to support larger fence panels. In preferred embodiments, a plurality of finished concrete picket fence replacement frames 6 may be welded along the length of the metal tube 5 creating a series of fence panels either vertically or horizontally to meet specification of installation.

In some embodiments, the finished frames 6 may be spaced to various lengths to adjust the degree of visibility allowed by the fence. The finished frames 6 vary in height and width according to the specification required. The installation of the preferred embodiment is comprised of welded secure bonds to adhere the finished concrete picket fence replacement frames 6 to the metal tube 5 and should not be a limitation on the described invention.

Figure 2:
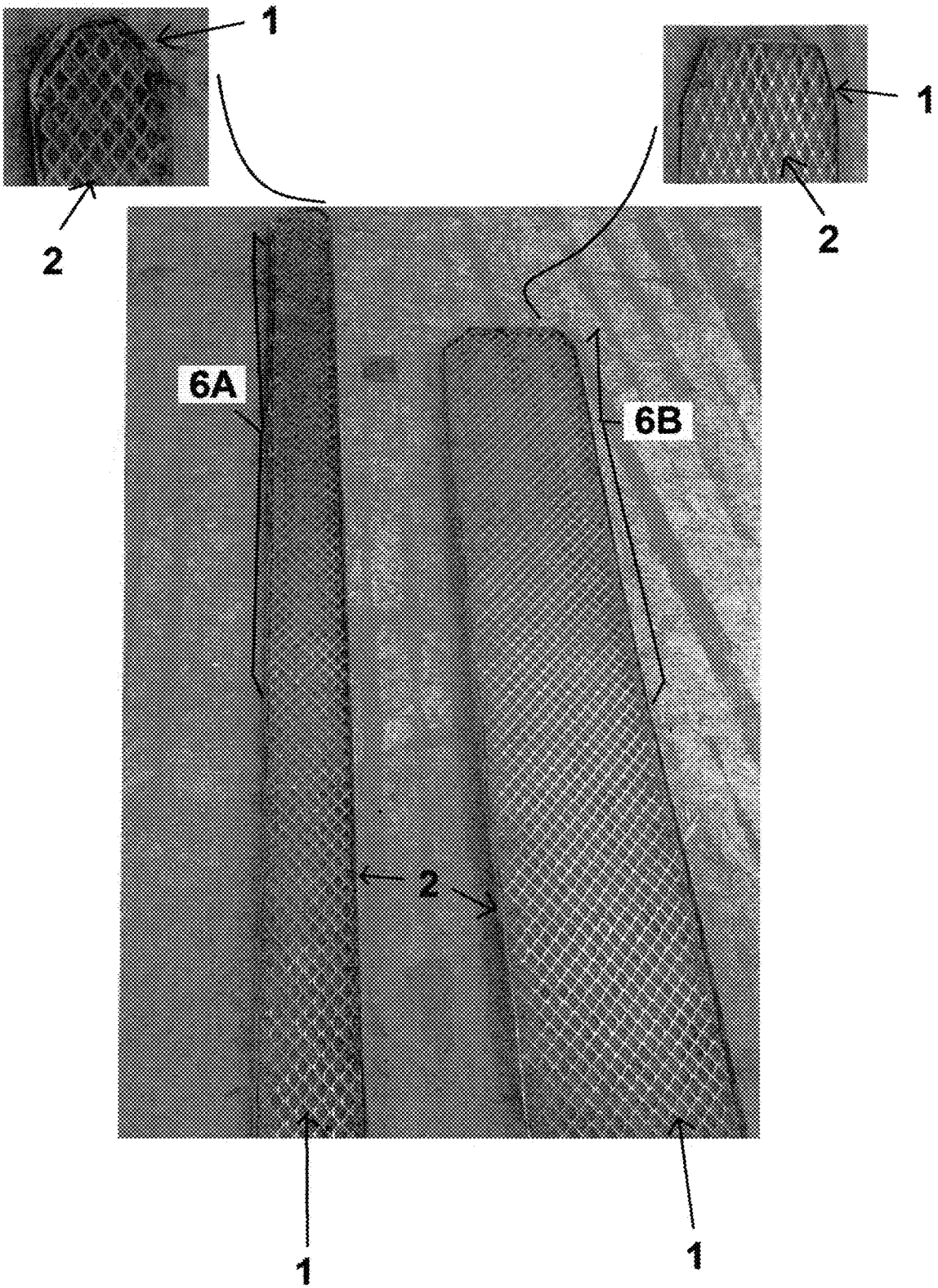
FIG. 2 depicts a perspective view of two examples of concrete picket fence replacements 6A, 6B according to various embodiments described herein.

From a perspective view of two concrete picket fence replacement panel 6 examples in FIG. 2, the textured face can be seen on two fence panels of various dimensions according to various embodiments described herein. As shown in FIG. 6A, the materials of the product have been fashioned together to form a finished frame 6 with dimensions of 1"×3"×8'. Increasing the dimensions of the metal plate 1 border and the expanded metal 2 can create larger fence panels with dimensions of 1"×5"×6' as best shown in FIG. 6B.

In some embodiments, the finished frame 6 may be comprised of various metals, hardened alloys, or metallic compositions to increase strength of the concrete picket fence replacement panel. In various embodiments, the height, length, weight, and use may vary to meet the specification. In preferred embodiments, comprised is a metal plate 1 affixed to a piece of precut expanded metal 2 either by tach welding, wire welding, or other means of permanent bond. In preferred embodiments like the ones in FIG. 2, the top of the fence frame 6A and 6B may be comprised of a picket style top to provide the realistic fence appearance. Still in other embodiments, the top may be comprised of square, round, or other artistic design and is not a limitation on the present invention as described herein.

Figure 3:
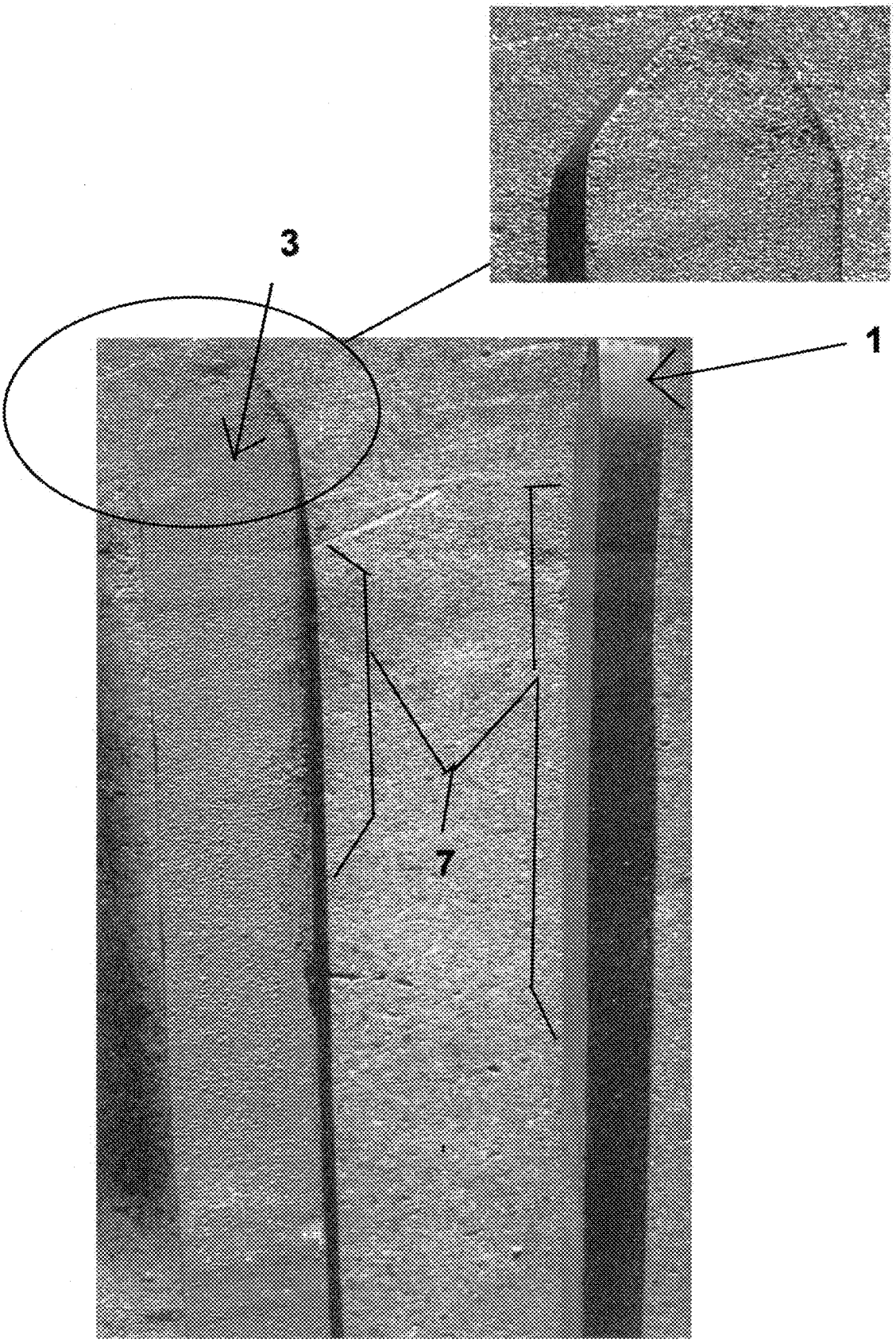
FIG. 3 depicts a front profile view of one example of a finished concrete picket fence replacement 7 according to various embodiments of the present invention.

Referring now to FIG. 3, comprised is a front and side profile view of one example of a finished concrete picket fence replacement according to various embodiments of the present invention. In some embodiments, the surface of the finished frame 7 may comprise a smooth surface, or textured surface to resemble the appearance of a wooden fence. In preferred embodiments, comprised is a finished frame 7 cured with the traditional fence design. In some embodiments, the surface may be stained, stamped, imprinted, designed, or other artistic endeavor without decreasing the quality or the strength and is not a limitation on the above referenced invention described herein. In preferred embodiments, the top of the frame comprises a picket style 6A and is welded together.

Figure 4:
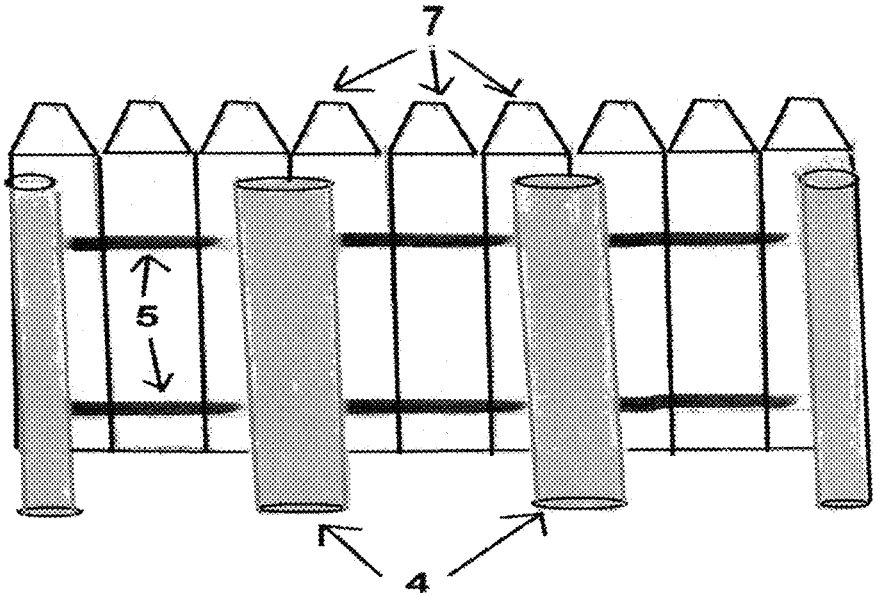
FIG. 4 depicts an example of a series of interlocking concrete picket fence replacement frames 7 affixed vertically in a strong matrix-like form to build a solid structure according to various embodiments described herein.
Figure 4:
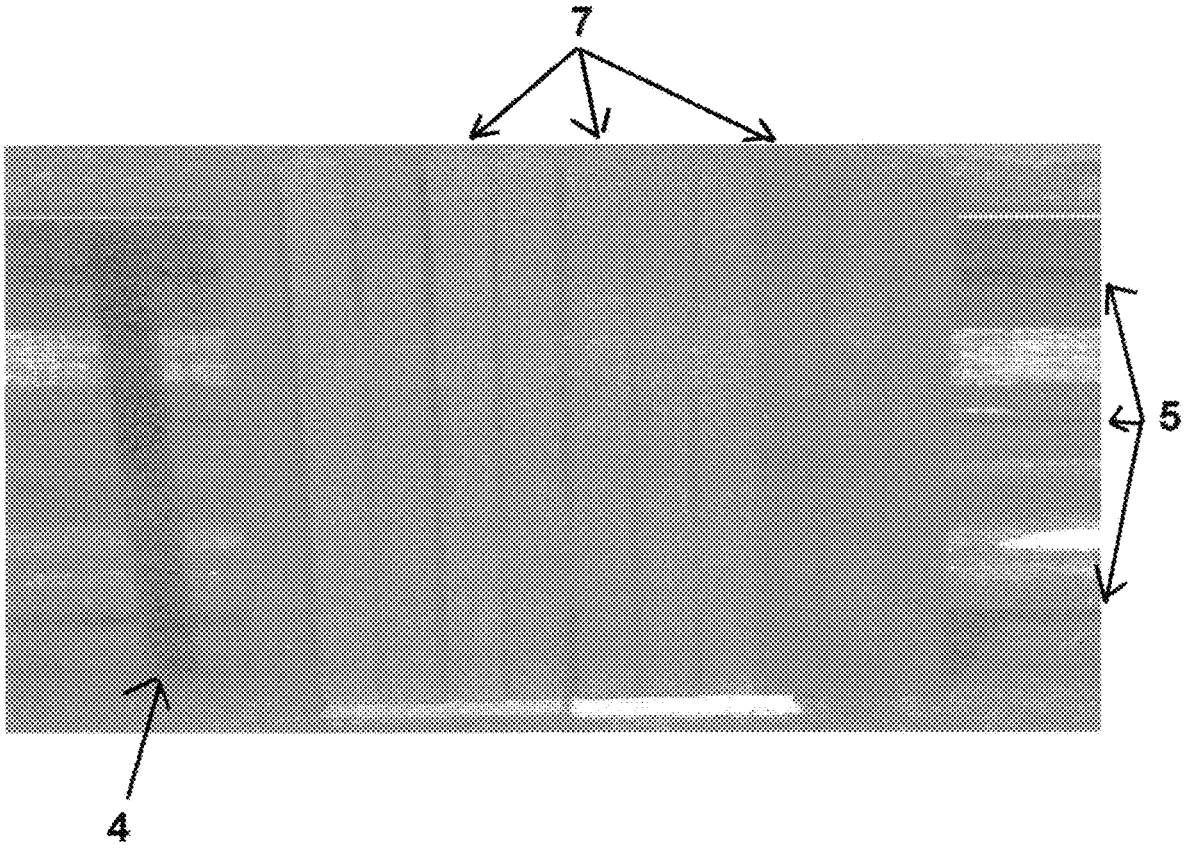

FIG. 4 depicts a sketch of the original invention, and an example of a series of interlocking concrete picket fence replacement frames affixed vertically in a strong matrix-like form to build a solid structure according to various embodiments described herein. In preferred embodiments, the concrete picket fence replacement panels 7 may be affixed vertically to the metal tube 5 by welding the frame 7 to the tube 5 at points of contact. In some embodiments, the finished frame panels 7 may be adhered by bolting, welding, or other method of adherence according to specification and is not intended to be a limitation on the present invention described herein.

In preferred embodiments, comprised is a standard fence panel affixed vertically for the average house to replace the old style wooden picket fence. In some embodiments, the sequence of fence panels 7 may be taller, shorter, wider, or longer to meet the requirements of the specification. In preferred embodiments, the space between finished frames 7 may be decreased to provide more security and privacy, or increased to open up view across the fence.

The above referenced invention may be comprised of a series of fence frames 7 welded together to form a barrier of interlocking frames, comprising a border fence wall. In preferred embodiments, a gate and locking mechanism may be adhered to the fence by affixing a gate latch to one metal pipe 4 and a gate hook on another pipe four feet away. In preferred embodiments, the locking mechanism may be a latch, key turn, or other form and is not intended to be a limitation on the above referenced invention herein.

Figure 5:
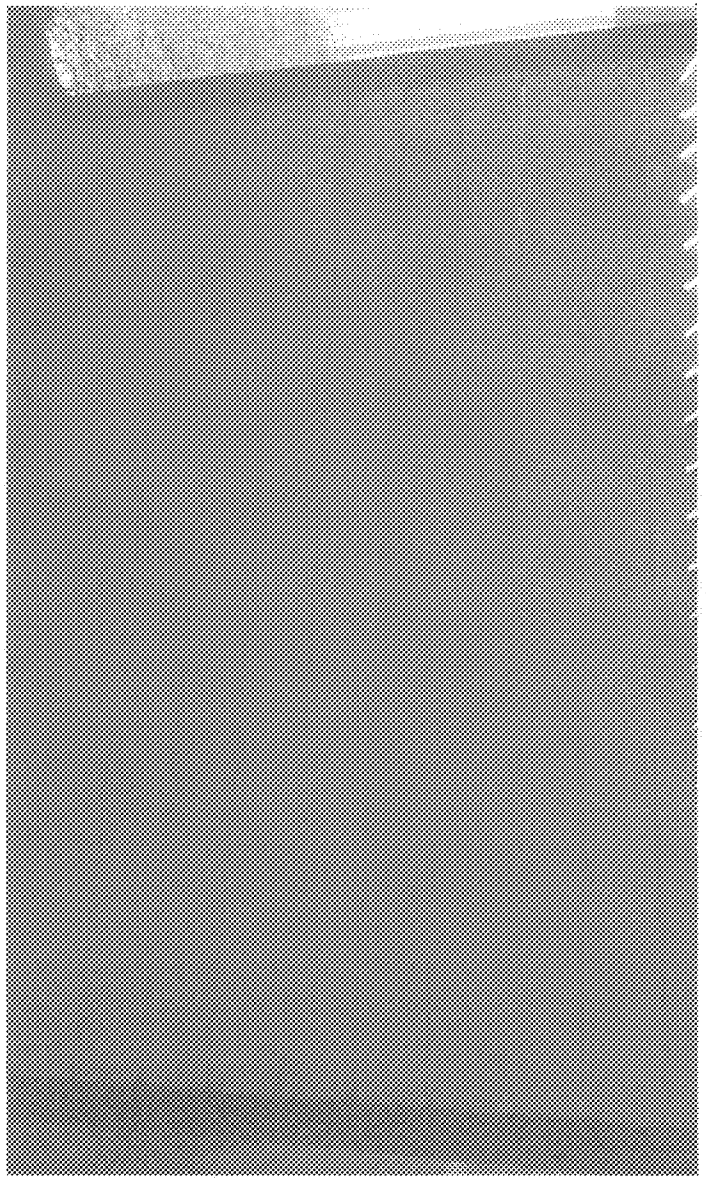
FIG. 5 depicts an example of a series of interlocking concrete picket fence replacement frames 7 affixed horizontally in a strong matrix-like form to build a solid structure according to various embodiments described herein.

FIG. 5 depicts an example of a series of interlocking concrete picket fence replacement frames affixed horizontally in a strong matrix-like form to build a solid structure according to various embodiments described herein. In preferred embodiments, the concrete picket fence replacement panels 7 may be affixed horizontally to the metal tube 5 by welding the frame 7 to the tube 5 at points of contact. In some embodiments, the finished frame panels 7 may be adhered by bolting, welding, or other method of adherence according to specification and is not intended to be a limitation on the present invention described herein.

In preferred embodiments, comprised is a standard fence panel affixed horizontally to provide a more agricultural style and barrier protection to replace the old style wood and wire cattle fences. In some embodiments, the sequence of fence panels 7 may be taller, shorter, wider, or longer to meet the requirements of the specification. In preferred embodiments, the space between finished frames 7 may be decreased to provide more security and privacy, or increased to open up view across the fence.

Concrete Picket Fence Replacement is a new and unique invention that takes the place of regular wooden fence panels. It is composed of the solid structures; concrete, rock, and metal.

When combined, the impenetrable solid frame can then be used in a similar manner as wood to create fence panels of various shapes and sizes.

Because of its construction and the materials chosen, Concrete Picket Fence Replacement is fire retardant and resistant to insect and animal attacks that would normally corrupt wood. It is also resistant to rain and flood waters that would normally warp wooden boards. It also provides safety against high winds, such as tornadoes, which would normally cause damage to wooden fence panels, or to nearby structures from flying debris.

The materials used to make the Concrete Picket Fence Replacement form can be found readily available and in abundance, making it inexpensive to manufacture.

Although the present invention has been illustrated and described herein, with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A method of manufacturing a concrete picket fence panel, the method consisting of steps: comprised of one solid metal frame formed to specification and coupled together to form an elongated rectangular panel; said coupling the metal frame member by welds at two short sides of the rectangular panel; attaching a precut expanded metal member into the rectangular panel; filling the rectangular panel with a concrete aggregate mix material; curing the concrete aggregate mix material; and further providing a hardening agent to strengthen the concrete picket fence replacement member.

* * * * *